US010413059B2

(12) United States Patent
Gautreaux

(10) Patent No.: US 10,413,059 B2
(45) Date of Patent: Sep. 17, 2019

(54) FIREARM SAFETY STORAGE APPARATUS

(71) Applicant: Austin Gautreaux, Sulphur, LA (US)

(72) Inventor: Austin Gautreaux, Sulphur, LA (US)

( * ) Notice: Subject to any disclaimer, the term of this patent is extended or adjusted under 35 U.S.C. 154(b) by 620 days.

(21) Appl. No.: 14/989,231

(22) Filed: Jan. 6, 2016

(65) Prior Publication Data

US 2016/0195363 A1 Jul. 7, 2016

Related U.S. Application Data

(60) Provisional application No. 62/100,142, filed on Jan. 6, 2015.

(51) Int. Cl.
*B65D 85/00* (2006.01)
*F41C 33/06* (2006.01)
*A47B 81/00* (2006.01)

(52) U.S. Cl.
CPC ..... *A47B 81/005* (2013.01); *F41C 33/06* (2013.01)

(58) Field of Classification Search
CPC ..... A47B 81/005; F41C 33/06
USPC ..... 206/3, 317, 468; 220/8, 345.1, 345.2
See application file for complete search history.

(56) References Cited

U.S. PATENT DOCUMENTS 2,308,480 A * 1/1943 Abbott ..... F42B 39/00 206/3
2,514,364 A * 7/1950 Bates ..... F42B 39/00 102/430
2,706,036 A * 4/1955 Neal ..... F41C 33/06 206/317
3,285,459 A * 11/1966 Gahm ..... A61J 7/0046 116/308
3,648,831 A * 3/1972 Arnone ..... B65D 11/12 206/468
4,155,608 A * 5/1979 Orlewicz ..... A47B 81/005 109/51
4,800,822 A * 1/1989 Adkins ..... A47B 55/00 109/19
4,936,038 A 6/1990 Johnson et al.
5,111,755 A 5/1992 Rouse
5,236,086 A * 8/1993 MacTaggart ..... F41C 33/06 206/317
5,669,495 A * 9/1997 West ..... A45C 5/03 190/110
5,829,586 A 11/1998 Mermell
6,405,861 B1 6/2002 Siler et al.
7,434,427 B1 * 10/2008 Miresmaili ..... F41C 33/02 109/47
7,478,724 B2 * 1/2009 Vor Keller ..... F41A 17/02 206/317

(Continued)

OTHER PUBLICATIONS

Vertical News, Shelf with Secret Compartment and Hidden Locking System, Politics & Government Week, Feb. 21, 2013, NewsRx, Atlanta, Georgia, United States.

*Primary Examiner* — Luan K Bui
(74) *Attorney, Agent, or Firm* — Robert Devin Ricci; Lauren J. Rucinski; Kean Miller LLP

(57) ABSTRACT

A firearm safety storage apparatus is disclosed for the storage therein and ready accessibility of a handgun or other valuables and weapons, said storage apparatus comprising an interior compartment, a frame, and an external cover whereby an access tunnel of a predetermined length is formed from the frame and the external cover so as to prevent the unauthorized access to the contents of the interior compartment.

15 Claims, 12 Drawing Sheets

(56) References Cited

U.S. PATENT DOCUMENTS

| | | | | |
|---|---|---|---|---|
| 8,443,737 | B2 | 5/2013 | Todd | |
| 8,726,704 | B2 | 5/2014 | White | |
| 2003/0057122 | A1* | 3/2003 | Bushnell | E05B 47/0002 206/317 |
| 2008/0179323 | A1* | 7/2008 | Circosta | A45D 44/18 220/8 |
| 2010/0301996 | A1 | 12/2010 | Stradiota | |
| 2014/0083338 | A1 | 3/2014 | McAlexander | |
| 2015/0136766 | A1* | 5/2015 | Rivas | B65F 1/02 220/8 |

* cited by examiner

Figure 6a
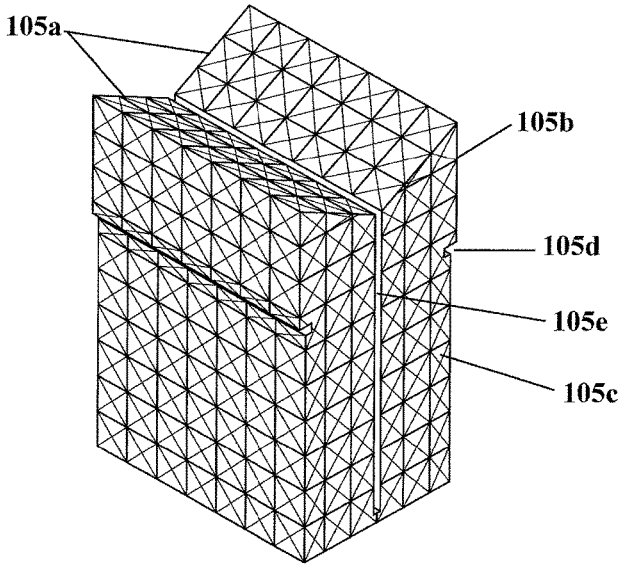
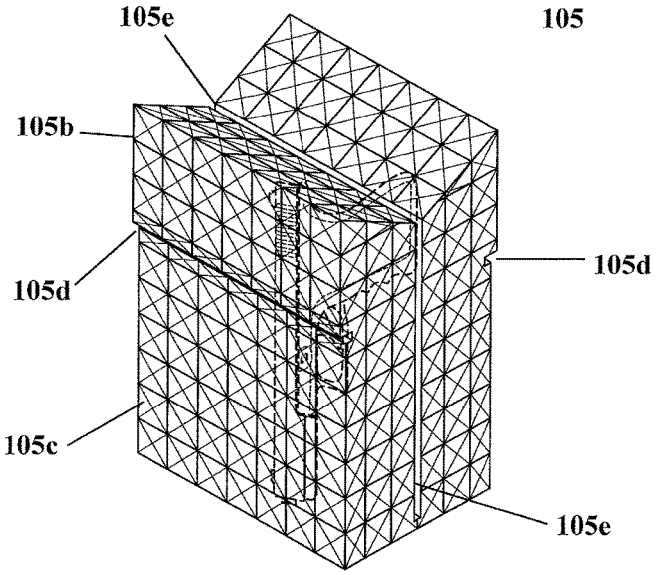
Figure 6b

FIGURE 7a
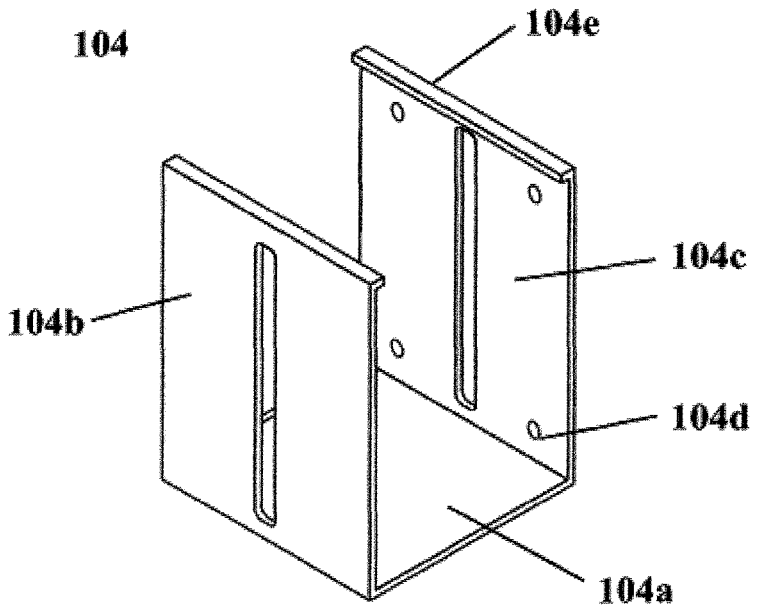
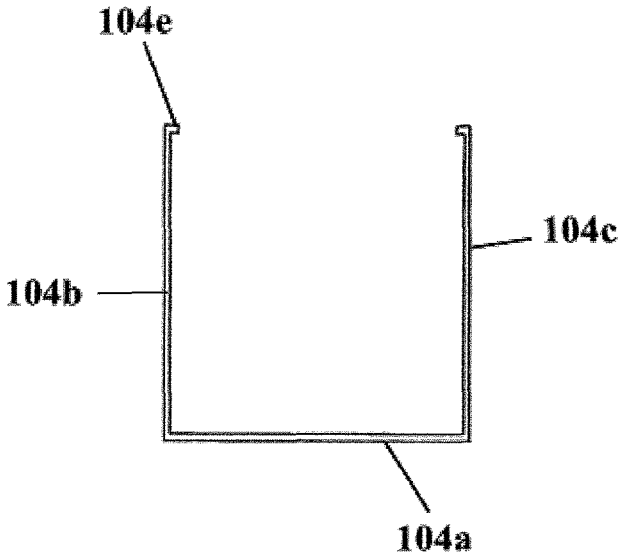
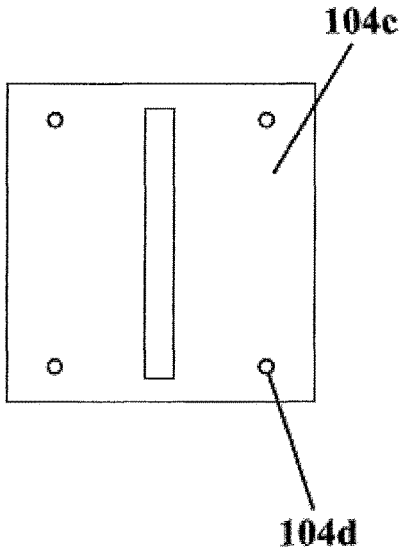
FIGURE 7b
FIGURE 7c

FIREARM SAFETY STORAGE APPARATUS

CROSS REFERENCE TO RELATED APPLICATIONS

This application claims priority to U.S. Provisional Application No. 62/100,142, entitled Firearm Safety Storage Apparatus, filed Jan. 6, 2014.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND

Millions of Americans own guns for numerous reasons including both self-defense and home defense purposes. A general perception of gun owners is that the possession of a weapon may be able to deter, prevent or thwart crimes such as robberies, attacks, or home invasions. However, most people do not carry a weapon on them at all times, particularly when in the confines of their home, and even more so at night when many burglaries are likely to be perpetrated. Many companies, individuals, and family units choose to store handguns and other weapons in their businesses or homes for safety purposes in order to offer protection from the persons who would commit such crimes. In order to be effective, the handgun must be stored in an easily accessible location such that the gun can be quickly and easily obtained by an authorized user in a time of need.

While guns can provide safety against home invaders and other criminals, they also pose a risk to the inhabitants of the home, particularly children who may stumble upon a loaded weapon. A large number of handgun owners hide loaded weapons in drawers, on top shelves of book cases and closets, and other various locations in an attempt to prevent children or other unauthorized users from obtaining the weapon and potentially causing damage to themselves. However, the truth is that these hiding places sometimes fail to prevent unauthorized access to the weapons, too often resulting in tragedies. Nearly every day a child is injured or killed by self-inflicted gunshot wounds due to misplaced or unsecured firearms.

A large number of handgun owners turn to gun safes to prevent unauthorized access to a stored weapon. The prior art is full of safes adapted for housing handguns with numerous forms of locking mechanisms of varying levels of sophistication to prevent unauthorized access to the weapon. For example, the prior art includes safes that use key locks, combination locks, hidden compartments, and/or digital locking means with code access to prevent unauthorized access to the handguns contained therein.

Although the handgun safes of the prior art may be useful in preventing unauthorized access, they are not without issues of their own. For example, unauthorized users including children may learn the location of the keys and hidden compartments, negating the very function the safes are intended to serve. Additionally, the locking mechanisms are only functional when properly used—i.e., a safe left unlocked will not prevent access no matter how sophisticated the lock. Moreover, by their very nature, handgun safes are designed to hinder easy access. Even an authorized user must disengage the locking mechanism of the safe before the firearm can be accessed. Such action requires both time and attention when neither may be available, particularly when quick access is required for defensive purposes.

The key to effective gun storage for defense purposes is thus to provide easy, quick access for authorized users at any time the gun may be needed, while preventing unauthorized users such as children from accessing the weapon. Thus, it is an objective of the present invention to store a firearm in a manner such as to safeguard the weapon from unauthorized users while allowing quick and easy access to authorized users. It is another objective of some embodiments of the present invention to provide a safe means of storing a weapon or firearm which prevents unauthorized access to the weapon or firearm to children based on the physical limitations of the unauthorized user such as a child.

DESCRIPTION OF THE DRAWINGS

The drawings constitute a part of this specification and include exemplary embodiments of the Firearm Storage Safety Apparatus, which may be embodied in various forms. It is to be understood that in some instances, various aspects of the invention may be shown exaggerated or enlarged to facilitate an understanding of the invention. Therefore the drawings may not be to scale.

FIG. 3(*b*) is a side view of the internal compartment showing additional connection means.

FIG. 5(*a*) is a front view of one embodiment of the Firearm Safety Storage Apparatus with the cover removed. FIG. 5(*b*) is a side view of one embodiment of the Firearm Safety Storage Apparatus. FIG. 5(*c*) is an angled view of the front/side of one embodiment of the Firearm Safety Storage Apparatus. FIG. 5(*d*) is the same view as FIG. 5(*c*) with the cover attached. FIG. 5(*e*) is a front view of one embodiment of the Firearm Safety Storage Apparatus as the cover is being installed.

FIG. 6(*c*) shows an a top view of embodiments of the foam sheet gun securing means wherein a continuous gun holder bracket catch 104*e* on one side and an alternate embodiment wherein two separate bracket catches 104*e* are employed opposite.

FIGS. 7(*a*)-(*c*) shows multiple angles of the gun holder bracket. FIG. 7(*a*) is an angled view of one embodiment of the gun holder bracket; FIG. 7(*b*) is a side view showing the profile of one embodiment of the gun holder bracket; FIG.

7(*c*) is a side view showing the side of the same embodiment that attaches to the mounting bracket.

Figure 8A:
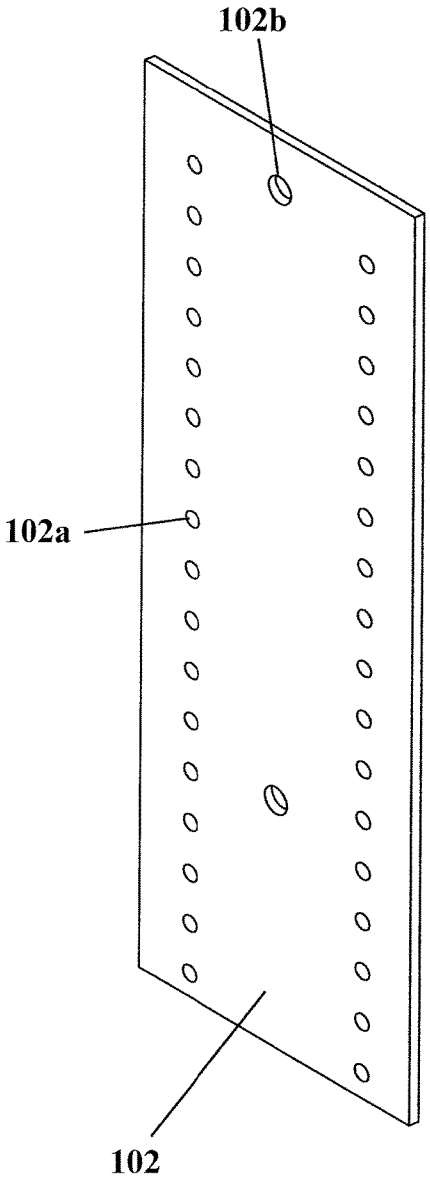
Figure 8B:
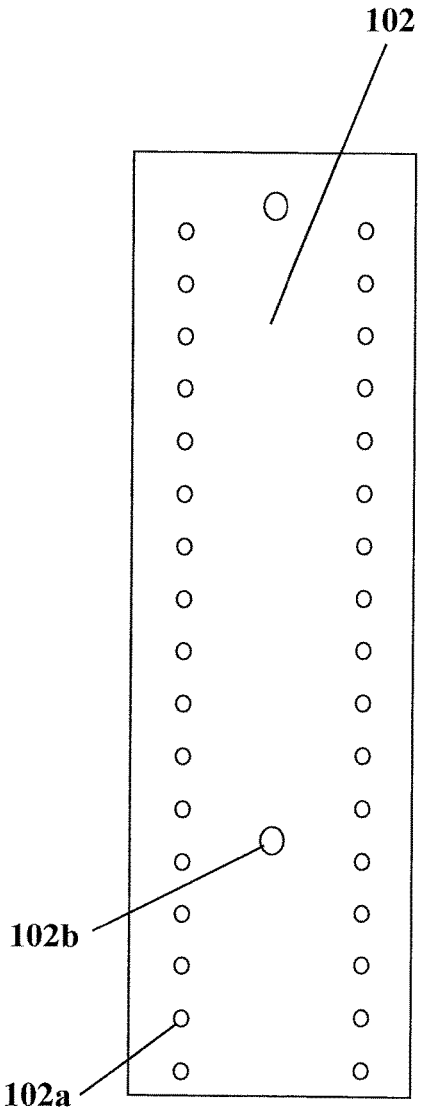

FIG. 8 shows various angles of the mounting plate. FIG. 8(*a*) is an angled view of one embodiment of the mounting plate. FIG. 8(*b*) is a frontal view of one embodiment of the mounting plate.

Figure 9A:
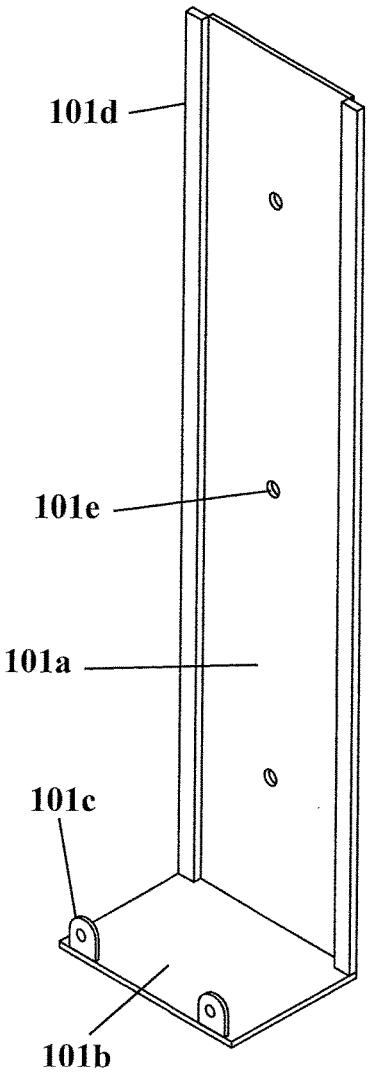
Figure 9B:
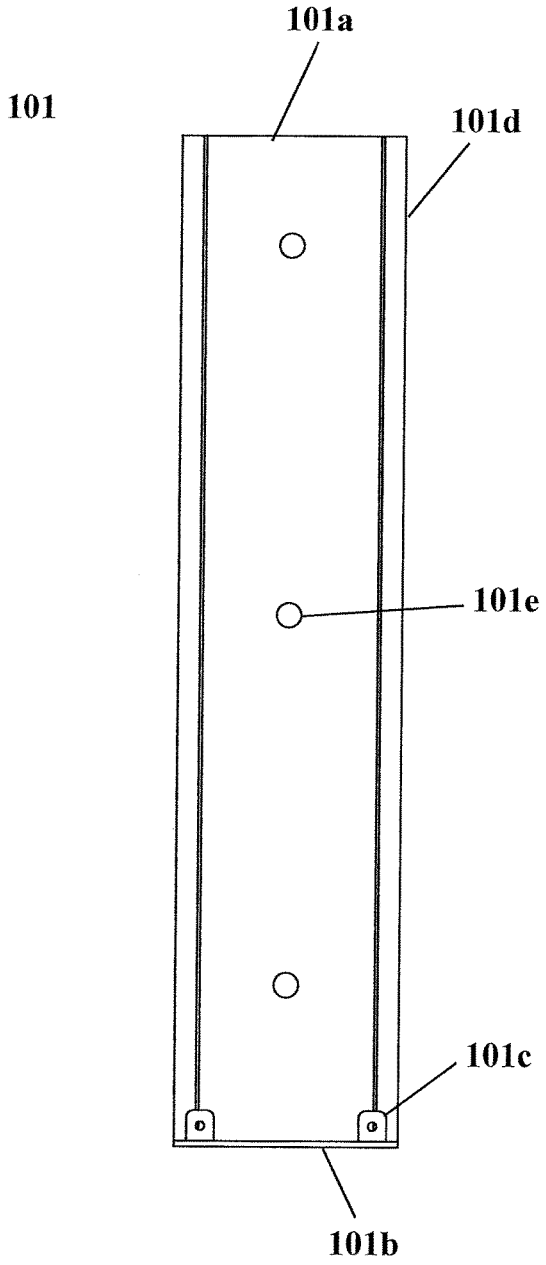

FIG. 9 shows various angles of the base plate. FIG. 9(*a*) is an angled view of one embodiment of the base plate of the Firearm Storage Safety Apparatus; and FIG. 9(*b*) is a frontal view of one embodiment of the base plate of the Firearm Storage Safety Apparatus.

Figure 1:
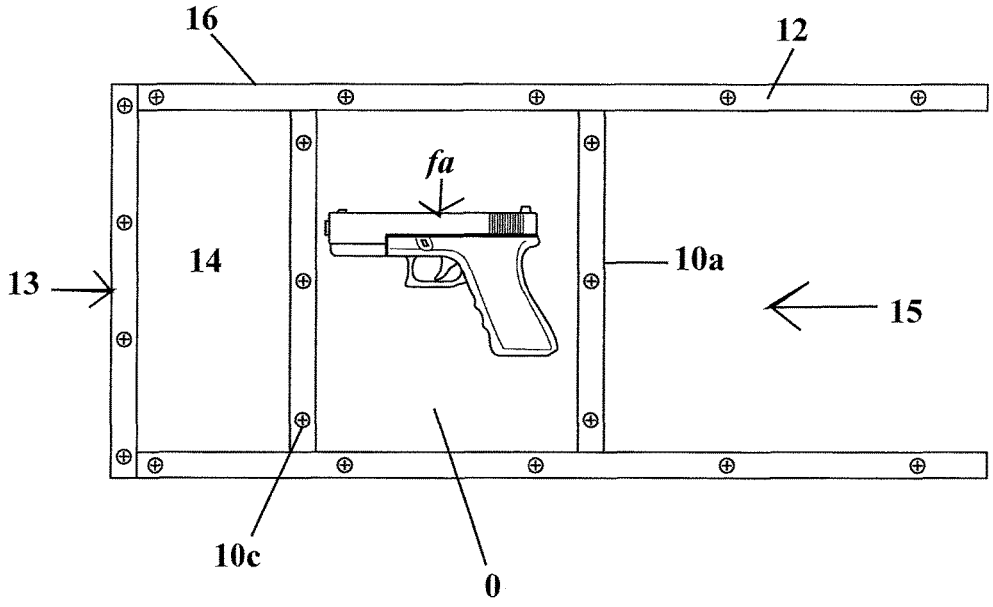
FIG. 1 is a schematic two-dimensional top view of the Firearm Storage Safety Apparatus showing a cross section of the apparatus with the external cover removed to show the location of a firearm inside the internal compartment.
Figure 4:
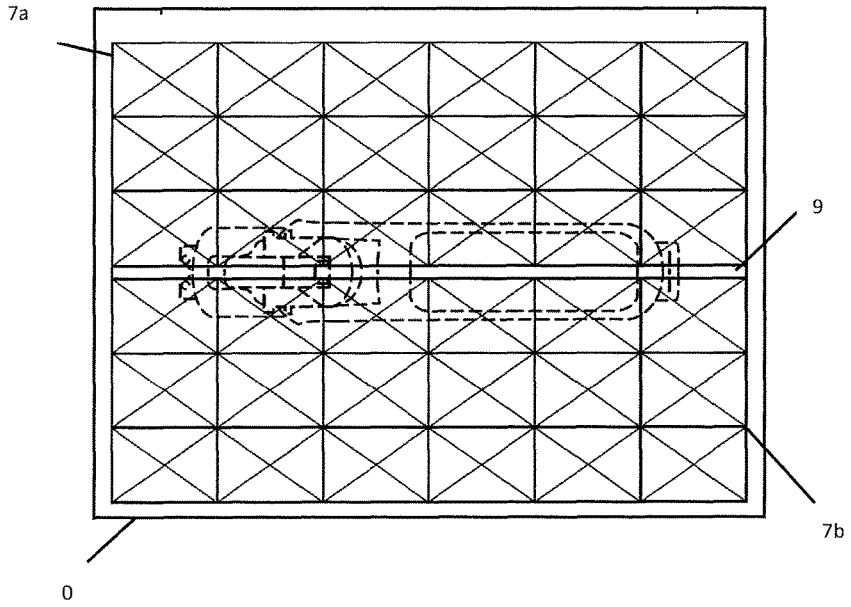
FIG. 4 is a cross sectional view of the internal compartment showing a firearm inserted. The figure is exaggerated to demonstrate different components and shows components adjacent to each other when they may in fact about each other in various embodiments.
Figure 10:
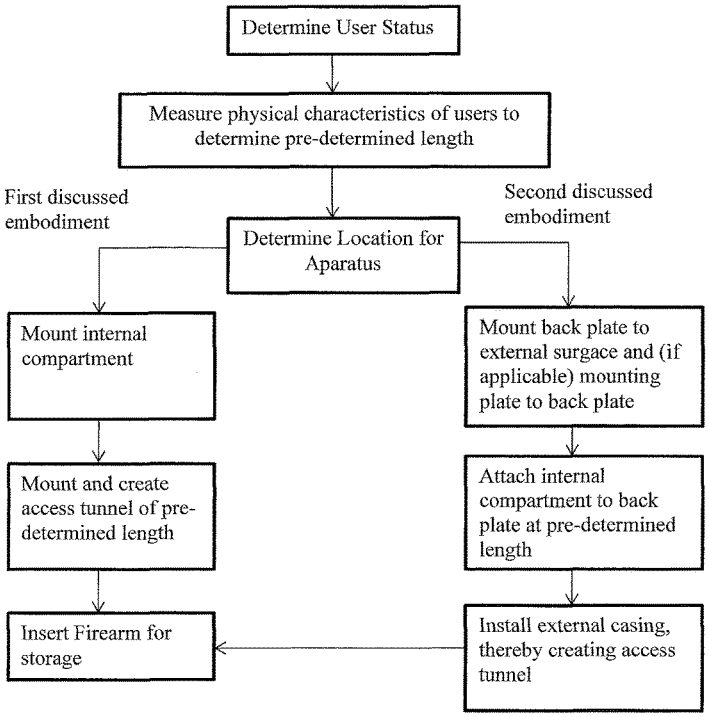

FIG. 10 is a flow chart diagram showing a method of installing two illustrative embodiments of the firearm storage safety apparatus as embodied in FIGS. 1 and 4.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described. Even then, the order of the steps may be modified based on the particular embodiment.

Furthermore, the described features, structures, or characteristics may be combined in any suitable manner in one or more embodiments. In the following description, numerous specific details are provided, such as examples of fasteners, mounting brackets, firearm securing means, and external covers. One skilled in the relevant art will recognize, however, that embodiments of the Firearm Safety Storage Apparatus may be practiced without one or more of the specific details, or with other methods, components, materials, and so forth. In other instances, well-known structures, materials, or operations are not shown or described in detail to avoid obscuring aspects of the invention. Thus, although two embodiments are provided herein to illustrate various features of the Firearm Storage Safety Apparatus, these illustrative examples should not limit the scope of the present invention.

A firearm storage safety apparatus is disclosed herein comprising, generally, an internal chamber unit capable of housing a weapon, a mounting means through which the Firearm Storage Safety Apparatus is capable of being attached to an external surface, and a casing, wherein the components are connected such that the mount is typically attached to an external surface, the internal chamber unit is attached to the mount, and the casing is attached to the mount forming an external casing unit such that the internal chamber resides in a compartment defined by the external casing unit. The mount and casing are also connected in a manner such that one end of the external casing unit is open thereby forming an access tunnel to the internal chamber unit housed within the external casing unit. The internal chamber unit is attached to the mounting bracket at a predetermined length from the opening in the external casing unit that would allow for a an authorized user to reach down the access tunnel in order to access the internal chamber, but is located at a distance great enough that an unauthorized user, such as a child, could not reach the internal chamber to withdraw the weapon.

Figure 2:
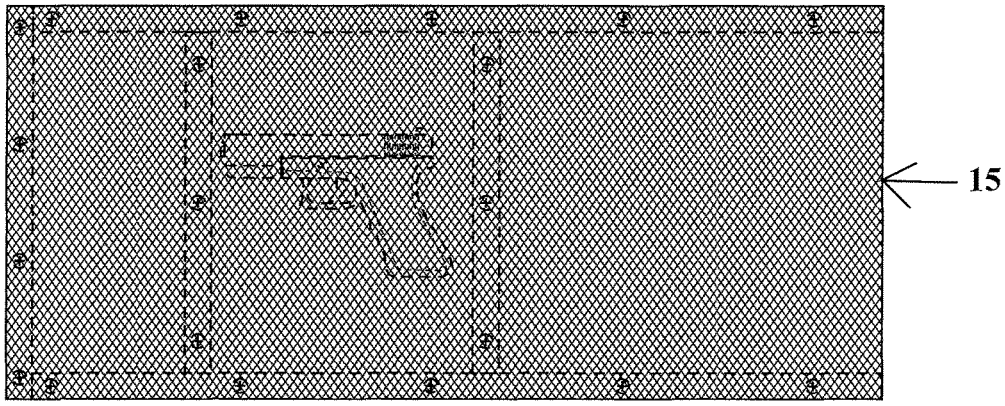
FIG. 2 is a rendering of the same cross-section in figure one with shading to show the presence of the external cover.

Turning to FIGS. 1-3, an embodiment of the Firearm Storage Safety Apparatus is disclosed herein comprising, generally, an internal chamber capable of housing a weapon, an adjustable mounting bracket, and an external cover which are interconnected in a manner such that the mounting bracket and external cover form an access tunnel through which an authorized user can access the weapon housed within the internal chamber, but an unauthorized user, such as a child, could not.

Figure 3A:
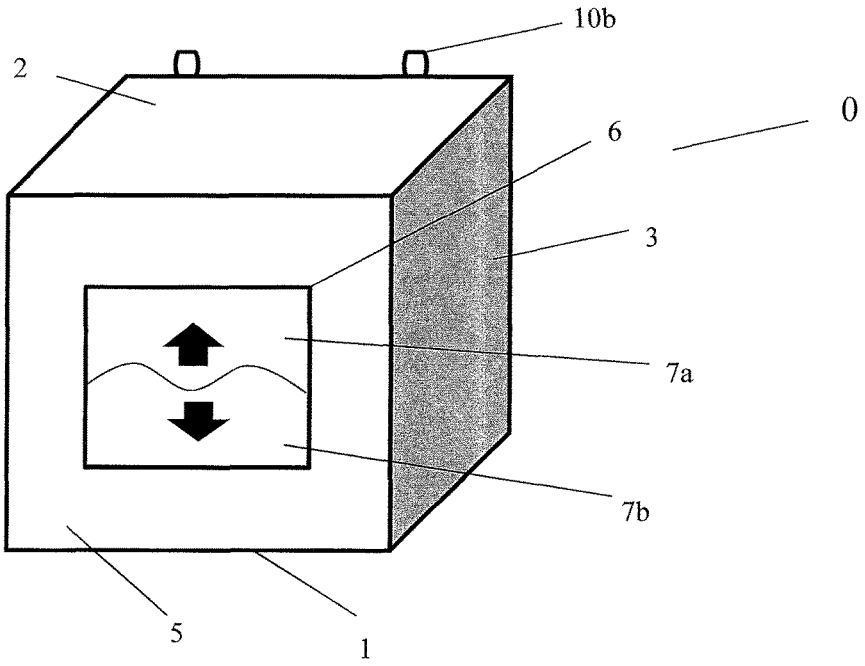
FIG. 3(*a*) is a is an angled view of the internal compartment showing access to the chamber defined by the internal compartment and the foam securing means for securing the firearm.
Figure 3B:
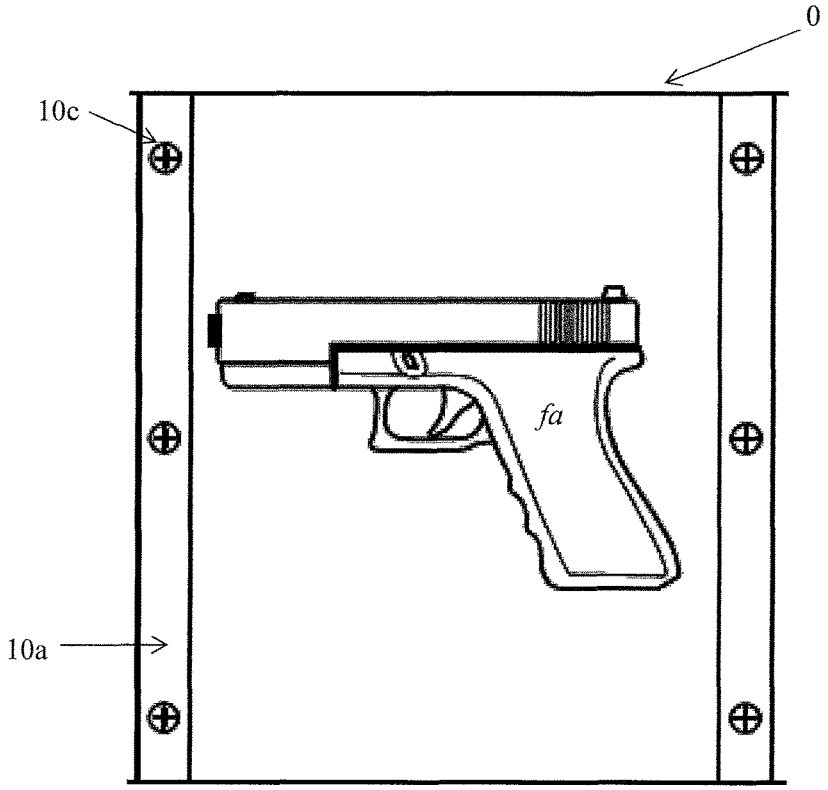

As shown best in FIGS. 3*a-b*, internal compartment 0 is a chamber into which an authorized user is capable of placing or storing a firearm fa. As shown herein, firearm fa is a handgun; however, it should be noted that any number of items could be housed inside the internal compartment 0, including weapons of various sizes and other valuables to which a user may wish to limit access. As depicted, internal compartment 0 comprises a series of walls including base wall 1 opposite a top wall 2, a pair of opposing side walls 3, a rear wall 4, and an access wall 5 opposite the rear wall 4, interconnected to form a cubed structure defining a chamber of substantial size so as to house the intended firearm fa. Access wall 5 comprises an access portal 6 of sufficient height and width to allow for an authorized user to insert a firearm into the internal compartment 0 for storage when desired and to remove the firearm fa when needed. In the present embodiment, the walls which form internal compartment 0 are made of metal sheets such as of aluminum molded together to form a solitary cube structure; however, it would be readily appreciated that the walls may be formed of numerous materials such as iron, steel, other metals and ores, hardened plastics such as PVC, and the like, which are capable of preventing an unauthorized user from breaking into the compartment, thereby limiting access to the firearm fa through the access portal 6 in access wall 5.

As shown in FIG. 3(*a*) and further depicted in FIG. 4, the internal compartment 0 further comprises firearm securing means which secures the firearm fa inside the compartment when stored. In the present embodiment, the firearm securing means is a compression foam unit 7 formed from two connected layers of compression type foam, a top layer 7*a* and a bottom layer 7*b*. Top and bottom layers 7*a* and 7*b* are interconnected on the outer perimeters of the sides and rear so as to form a slit 8 in the front section, thus creating an envelope 9 within the compression form unit 7 into which the firearm fa may be inserted. As depicted, compression foam unit 7 is designed to fill substantially the entirety of the chamber formed by internal compartment 0. The compression foam unit 7 is placed within the chamber defined by the walls of the internal compartment 0 with slit 8 facing access wall 5 and is positioned so that the slit 8 is substantially aligned with the access portal 6 in order to allow a user to place the firearm fa into or remove the firearm fa from envelop 9 inside the compression foam unit 7 through the access portal 6 in access wall 5.

A person having ordinary skill in the art would readily recognize that alternate embodiments may be utilized which would employ various alternate forms of firearm securing means within the internal compartment 0, such as a gun holster or other fasteners, ties, magnets, straps, or the like. Additionally, embodiments could be conceived where the entirety of the internal compartment 0 comprises the securing means, such as if a gun holster were used as the internal compartment 0.

Turning back to FIGS. 3(*a*)-(*b*), internal compartment 0 is shown further comprising a mounting means 10 for attaching the internal compartment 0 to an exterior surface. The mounting means 10 is connected to the exterior internal compartment 0 at a location substantially juxtaposed to the base wall 1. In the presently depicted embodiment, mounting means 10 comprises a pair of mounting supports 10*a* which are elongated brackets that further comprise a series of pre-drilled holes through which fasteners 10*c* can be used to connect the structure to an exterior surface. As further depicted, the mounting means 10 further comprises attachment loops 10*b* which when mounted will correspond to pre-drilled holes on the mounting bracket 11 as shown in FIG. 1, thereby allowing both the internal compartment 0 and the mounting bracket 11 to be attached both to each other and to an exterior surface.

Turning next to FIGS. 1 and 2, the mounting bracket 11, which may or may not be independently adjustable or telescopic, is shown as a frame structure comprising a pair of longitudinal side frame members 12 and a cross bar 13. Each end of the cross bar 13 is welded to an end of a side frame member 12 in order to form a frame unit having a cross section substantially in the shape of a "U". Thus, the mounting bracket 11 has a closed end 14 where the cross bar 13 is welded to the side frame members 12 and an open end 15 opposite the closed end 14. The mounting bracket 11 is designed such that the gap created between the side frame members 12 and cross bar 13 is diametrically larger than the width of the internal compartment 0, thereby allowing the internal compartment 0 to be positioned within the frame's gap. Typically, the internal compartment 0 would be positioned inside the gap of the mounting bracket 11 with the access wall 6 facing away from the closed end 14 and towards the open end 15.

The mounting bracket 11 depicted in FIG. 1 is designed to be mounted to an external surface. A plurality of mounting holes 16 are formed into the side frame members 12 and cross bar 13 through which a user can mount the mounting bracket 11 to an external surface such as a wall via fasteners 17 (not shown). The mounting bracket 11 is designed to be attached to numerous types of external surfaces such as walls, counters, furniture, and the like. Numerous types of fasteners or fastening agents could be employed to attach the mounting bracket 11 to the external surface.

As depicted, external cover 20 is a fabric covering which attaches to the mounting bracket 11 at and alongside side frame member 12 and cross bar 13, forming access tunnel 25. The external cover 20 forms a tight fit along the side frame members 12 of the mounting bracket 11, but does not connect to the mounting bracket 11 on the open end 15, thereby creating an opening in the access tunnel 25 through which an authorized user can access the contents of the internal compartment 0. In the present embodiment, external cover 20 is a Kevlar fabric of sufficient length to cover the entirety of the mounting bracket 11 and sufficient width in at least one section so as to cover the internal compartment 0, although other lengths can be used so long as it is capable of creating an access tunnel (to be discussed) of sufficient length. The Kevlar fabric of the external cover 20 is wrapped around the mounting brackets 11 whereby it is sewn onto itself (external cover attachment means 21, not depicted), creating a sleeve around the mounting bracket 11. In such an embodiment, mounting holes 16 may be drilled through the Kevlar fabric to match the mounting holes 16 of the mounting bracket 11, thereby allowing for the access tunnel unit 22 to be attached to an external surface via fasteners 17.

In alternate embodiments, the external cover 20 can be made of various materials of sufficient rigidity to prevent an unauthorized user from either removing the external cover 20 or otherwise manipulating the external cover 20 in order to access the contents of the internal compartment 0. For example, the external cover 20 could be formed from multiple forms of fabrics, metals, ores, woods and hard plastics which would attach to the mounting brackets 11 in order to create an access tunnel of sufficient rigidity so as to prevent unauthorized access to the contents of the internal compartment 0 housed at the closed end 14 of the access tunnel 25. Likewise, the external cover 20 can be attached to the mounting bracket 11, thereby creating the access tunnel unit 22, through various attachment means, including, but not limited to, fasteners, rivets, sewing, bolts, zippers, ties, and the like.

For illustrative purposes only, and not to be limiting, an example is provided herein for setting up the present embodiment of the Firearm Storage Safety Apparatus in a familial household in order to store a weapon in a manner which is easily accessible to an authorized adult user, but out of the reach of an unauthorized child user. Thus, turning specifically to FIG. 10, a schematic flow chart diagram is provided showing a simplified scheme for installing the Firearm Storage Safety Apparatus.

First, a determination is made as to who will constitute authorized and unauthorized users based on a pool of those that may attempt to access the firearm fa to be kept within the internal compartment 0 of the Firearm Storage Safety Apparatus. For the purposes of this illustration, the adults in the household generally will comprise the authorized users while the children in the household will comprise the unauthorized users. Next, the arm length of at least the authorized user with the shortest arm and the unauthorized user with the longest arm is measured. A person having ordinary skill in the art would recognize that multiple methods, devices, and combinations thereof could be used to measure the arm length of the potential users. Under certain circumstances, it may be desirable to measure the arm length of the unauthorized child user from the shoulder to his or her fingertips in order to ensure that the maximum potential reach length is measured, while it may be desirable to measure the arm length of the adult user from the user's chest to the a location substantially near the middle of his or her hand to ensure adequate reach to easily access the weapon in a time of need.

Next, the location where the Firearm Safety Storage Apparatus will be placed is determined. For the purposes of this example, the Firearm Safety Storage Apparatus will be mounted to a typical wall located in the home. Once the location is determined, the internal compartment 0 is mounted to the wall via fasteners 10*c*. To do so, the internal compartment 0 is placed on the wall such that base wall 1 is substantially flush with the wall and with the access wall 5 in the desired direction. Internal compartment 0 is mounted to the wall via the screws and bolts which comprise internal compartment fasteners 10*c*. The means for mounting screws or bolts into a wall or stud are well known in the art and typically involve locating wall studs and pre-drilling guide inserts with a drill bit. It is preferable that the fasteners 10*c* connecting at least one mounting support 10*a* are connected into a stud; however, in various embodiments, dry-wall screws and other attachment means can be employed when a stud is not present or locatable.

With the internal compartment 0 mounted to the wall, the next step is to mount the access tunnel unit 22 comprising the mounting bracket 11 and external cover 20 to the wall. It is to be noted that in alternate embodiments, the mounting bracket 11 may be mounted to the wall before the internal compartment. In the present embodiment, the external cover 20 is a Kevlar like fabric which is looped around the mounting bracket 11 and back onto itself whereby it is sewn together via external cover attachment means 21. Likewise, guide holes have been drilled or cut into the Kevlar fabric which align with the mounting holes 16 of the mounting bracket 11, thereby allowing fasteners 17 to pass through both the matching holes in the external cover 20 and the mounting bracket 11.

The predetermined length is measured against the access tunnel unit 22 in order to determine the proper location where the unit should be mounted. Generally, the predetermined length should be substantially equivalent to the distance between the open end 15 and the access wall 5 of the internal compartment 0. The mounting bracket 11 is so positioned based on the predetermined length with the mounting holes 16 lined up with the attachment loops 10*b*. With the access tunnel unit 22 in place, fasteners 17 such as screws and bolts are drilled or wrenched through the mounting holes 16 and attachment loops 10*b* and into the wall. At this point, it is suggested that the user test the access tunnel 25 to ensure that the proper length has been achieved such that the authorized user is capable of access the contents of the internal compartment 0 while an unauthorized user could not be so capable. Additional fasteners 17 are then employed at various other mounting holes 16 along the mounting bracket 11 to firmly secure the unit to the wall. Finally, with the Firearm Safety Storage Apparatus securely installed to the wall, the user can insert the firearm fa into the unit for storage. To do so, the user passes the firearm fa through the open end 15 into the access tunnel unit 22 and continues to insert the firearm fa down the access tunnel 25, through the access portal 6 of access wall 5 whereby the firearm fa is inserted through slit 8 into the envelope 9 of internal compartment 0 where it is housed when not in use.

Turning to FIGS. 4-9, a second illustrative embodiment of the Firearm Safety Storage Apparatus is depicted to aid in understanding the present invention, wherein the length of the access tunnel is adjusted through an internal mounting means 10 instead of the positioning of the mounting bracket 11 in relation to the internal compartment 0. In effect, the same goal is accomplished, but the unit contains its own backing with base plate 101 that remains stationary, allowing for easier and more secure mounting.

As depicted in FIG. 4, firearm safety storage apparatus 100 comprises, generally, a base plate 101, an internal gun holder unit 103 further comprising a gun securing system 105 and gun holder bracket 104, a mounting plate 102 for mounting the gun holder unit 103 to the base plate 101, a cover 106 which attaches to the base plate 101 around the internal gun holder unit 103, and a plurality of securing and attaching components and means. As with the previous embodiments discussed, the cover 106 and base plate 101 form an external casing unit 107 which has an opening on one end. The cavity defined by the external casing unit 107 forms an access tunnel 108 to the internal gun holder unit 103 housed within the external casing unit 107. However, the means for setting the length is slightly different than the previously discussed embodiment. In the present embodiment, the internal gun holder unit 103 is attached either directly to the base plate 101 or indirectly such as through the use of mounting plate 102. The internal gun holder unit 103 is attached to the base plate 101 at a determined length from the opening in the external casing unit 107 to allow for a an authorized user to reach down the access tunnel 108 in order to access weapon stored inside and to prevent an unauthorized user from doing so. But, in this embodiment, instead of moving an external bracket to account for the determined length as was the case in the previously discussed embodiment, the gun securing system 105 is positioned and attached to the base plate 101 at the determined length.

FIGS. 4-9 depict the base plate 101, mounting plate 102, gun holder bracket 104, gun securing system 105, and cover 106. For illustrative purposes, the Firearm Storage Safety Apparatus as disclosed in this embodiment will be discussed from the back (base plate) outwards towards the front (cover), although these terms are relative. Turning first to FIG. 9, an illustrative example of a base plate 101 is shown from multiple angles. Base plate 101 acts as the backbone of the storage apparatus 100 and is used to attach the apparatus to an external surface such as a wall or piece of furniture. As depicted, the base plate 101 comprises a vertical wall 101*a* attached substantially orthogonally to base plate bottom 101*b*. Vertical wall 101*a* is an elongated rectangular wall defined by a top and bottom edge and two opposing side edges. The side edges are further defined by raised ridges 101*d* which substantially span the entire length of the side edges from the top to the bottom of the vertical wall 101*a*, although other configurations are possible. As will be discussed below, these raised ridges 101*d* help to connect the cover 106 to the base plate 101. Additionally, one or more, but preferably two or more, bottom braces 101*c* are attached to the outer edge of the base plate bottom 101*b* in a substantially orthogonal manner such that the bottom braces 101*c* are substantially parallel to and in line with the vertical wall 101*a*. The bottom braces 101*c* also aid in connecting the cover 106 to the base plate 101. The face of vertical wall 101*a* further comprises fastener apertures 101*e* through which fasteners such as, but not limited to, bolts or anchors can be inserted to attach the base plate 101 to an external surface.

Figures 5A, 5B, 5C:
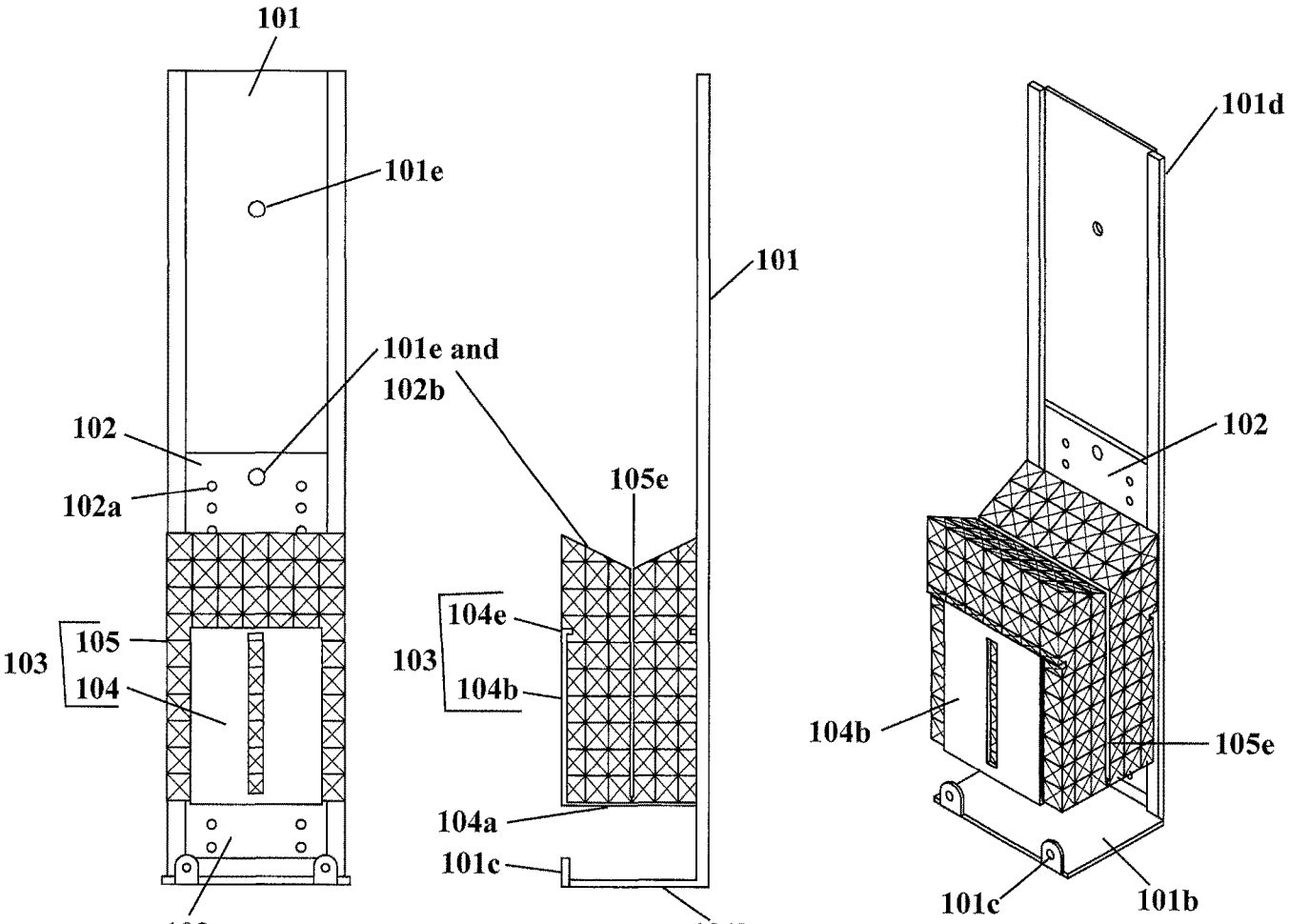
FIGS. 5(*a*)-(*e*) show the components of a second embodiment of the firearm safety storage apparatus in various states of assembly and from different angles.
Figure 5D:
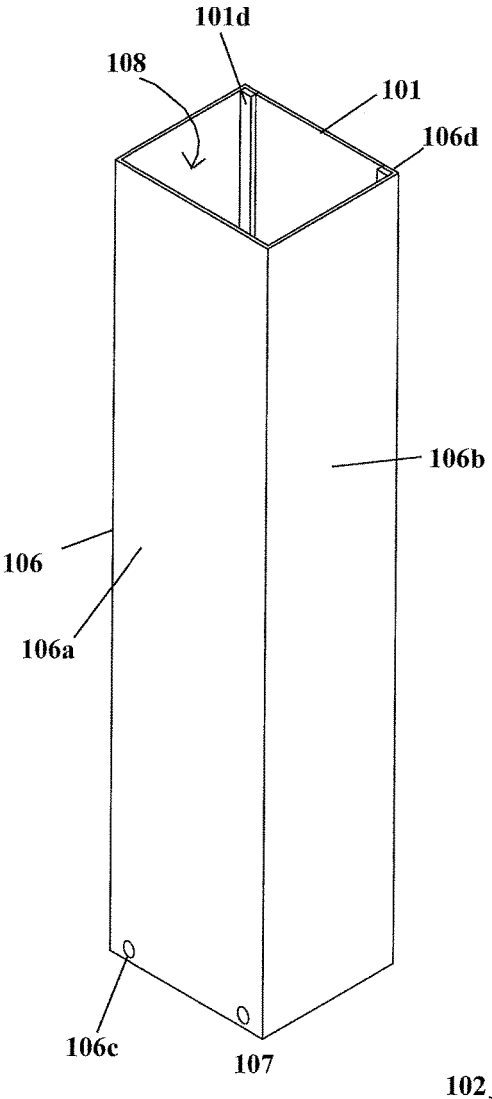
Figure 5E:
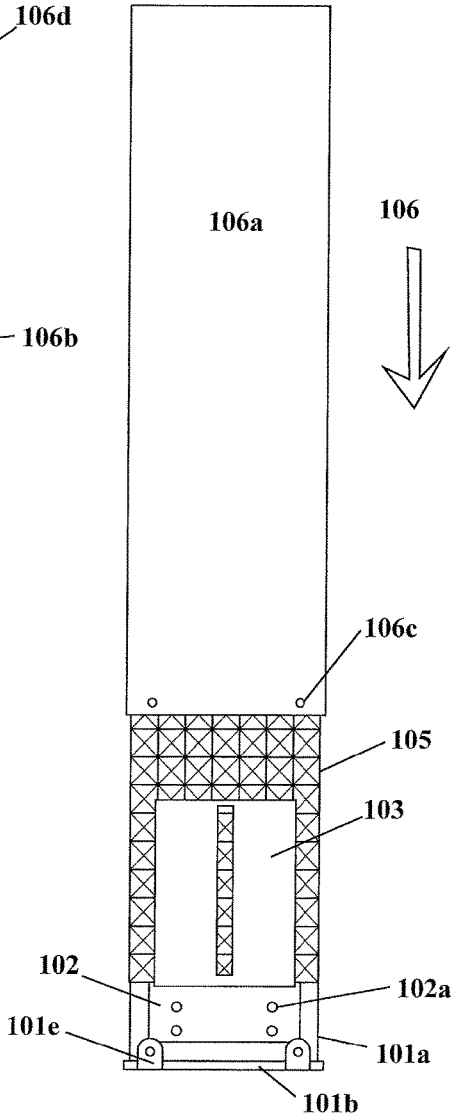
Figure 6C:
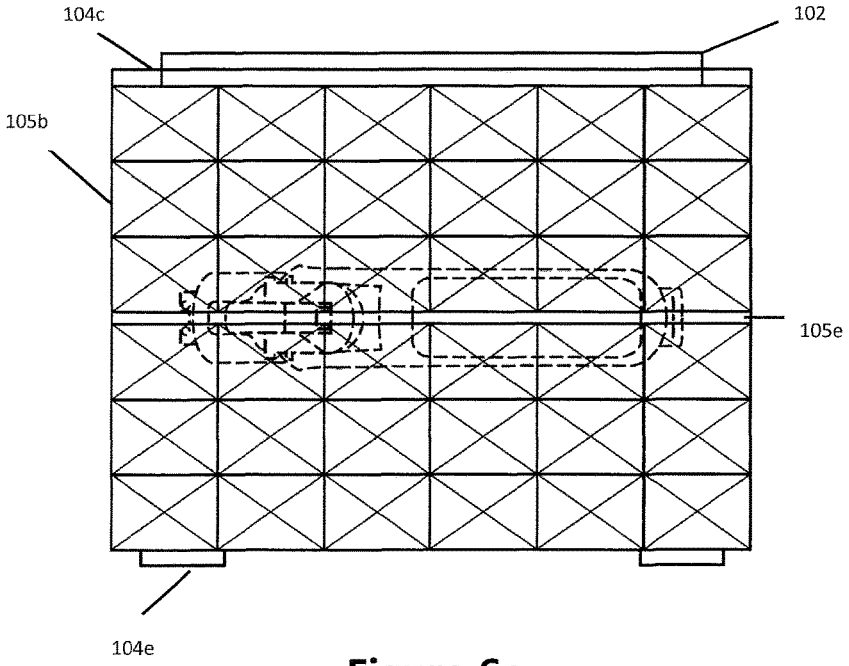
FIGS. 6(*a*) and (*b*) show an angled view of one embodiment of the foam sheet gun securing means with (in 6(*b*)) and without (in 6(*a*)) a firearm inserted.

Turning next to FIGS. 5-7, the components of the internal gun holder unit 103 are shown. These components comprise, generally, gun holder bracket 104 and gun securing system 105. Although various means can be employed to secure the weapon, the depicted gun securing system 105 utilizes two sheets of foam 105*a* which are mirror images of each other and are laid on top of each other to form an internal and external layer on each sheet of foam 105*a*, although various other setups can be employed. Turning specifically to FIG. 6(*a*)-(*b*), each sheet of foam 105*a* is shown comprising a top portion 105*b* and a bottom portion 105*c* separated by a crevice 105*d* which is an indentation or partial trough in the external side of the sheet of foam 105*a*. As depicted, the top portion 105*b* of each sheet of foam 105*a* protrudes outwards and is diametrically larger than the bottom portion 105*c*, although this is not required in all embodiments. In embodiments wherein two separate sheets of foam 105*a* are utilized, the space between the two sheets of foam 105*a* defines the firearm chamber 105*e* which is an envelope or cavity into which the firearm fa can be placed. Although the sheet of foam 105*a* is not the only means for securing the firearm, its ability to compress and return to its natural state are useful for securing the firearm fa in such a means as to allow for easy insertion and retrieval. The sheet of foam 105*a* is manipulated and compressed to allow the firearm fa to be inserted into firearm chamber 105*e*. Once inserted the user will stop manipulating the sheet of foam 105*a*, allowing the sheet of foam 105*a* to expand towards its resting state whereby the firearm fa will be secured between the sheets of foam 105*a*. In alternate embodiments, such as the one depicted in FIG. 5(*b*), a single block of foam 105*a*' is utilized. In such an embodiment, a wedge or slit is cut in the block of foam 105*a*', thereby forming and defining a firearm chamber 105*e*'.

In the previously discussed embodiment, the internal compartment 0 comprised a box-like structure as depicted in FIG. 3. However, in the current embodiment as shown in FIG. 7(*a*)-(*c*), a minimalist gun holder bracket 104 is employed which is a "U"-shaped bracket comprising generally a base 104*a*, a front vertical wall 104*b* and a back vertical wall 104*c*. The vertical walls are substantially orthogonally connected to the base 104*a* and extend in the same direction and parallel to each other from the base 104*a*. Back vertical wall 104*c* comprises fastener apertures 104*d* through which the gun holder bracket 104 can be attached to the base plate 101 either directly or indirectly such as through mounting plate 102. On the sides opposite base 104*a*, both the front and back vertical walls 104*b* and 104*c* further comprise edges that curve inwards towards each other. These edges form gun holder bracket catches 104*e*. In use, as shown in Figure the bottom portion 105*c* of the gun securing system 105 is compressed and inserted into the gun holder bracket 104 such that the external bottom side of the bottom portion 105*c* comes into contact with the base 104*a* of the gun holder bracket 104. When the sheet of foam 105*a* is allowed to decompress, it expands and the external sides of the bottom portion 104*c* contact the inner walls of the gun holder bracket 104, i.e., the inner walls of both the front vertical wall 104*b* and a back vertical wall 104*c*. Additionally, the bottom portion 105*c* of the sheets of foam 105*a* is cut such that when the sheets of foam 105*a* expand, the gun holder bracket catches 104*e* enter into the crevices 105*d* on the exterior sides of each sheet of foam 105*a*, thereby holding the sheet of foam 105*a* into place, and forming a complete internal gun holder unit 103.

In certain embodiments, a mounting plate 102 is employed to indirectly mount the internal gun holder unit 103 to the base plate 101. An embodiment of the mounting plate 102 is best shown in FIGS. 8(*a*) and (*b*). An advantage to using a mounting plate 102 is that it may make it easier for an authorized user to change the position of internal gun holder unit 103, such as when it needs to be adjusted to account for new authorized users or growing children who remain unauthorized. Mounting plate 102 comprises, generally, a rectangular plate with a plurality of larger apertures 102*a* which coincide with the fastener apertures 101*e* of base plate 101 as shown in FIG. 5(*a*) such that the bolt or anchor used to mount the base plate 101 to the external surface can pass through the larger apertures 102*a* and fasten the mounting plate 102 to the base plate 101. The mounting plate 102 also comprises a plurality of smaller apertures 102*b*, typically in two vertical columns. The columns comprising the plurality of smaller apertures 102*b* are spaced apart in an equal distance to the fastener apertures 104*d* on the back vertical wall 104*c* so that the user can attach the gun holder bracket 104 to the mounting plate 102 at various locations as would be understood by one having ordinary skill in the art.

As previously discussed, the internal gun holder unit 103 is mounted in a position that is a pre-determined distance away from the end of the base plate 101 as this will be the distance of the access tunnel 108 formed when cover 106 is attached to the base plate 101. This distance is determined by measuring the arm lengths of authorized users such as the designated adults in a house hold and the arm lengths of the unauthorized users such as children in a household. The pre-determined distance should be greater than the longest arm length of the unauthorized users to prevent an unauthorized user from reaching the firearm, but shorter than the arm lengths of the authorized users to permit access to the authorized user. Additionally, the internal gun holder unit 103 should be mounted such that the opening to the firearm chamber 105*e* should face away from the base plate bottom 102*b* so that the firearm can be accessed through the access tunnel.

Once the internal gun holder unit 103 is in place, the cover 106 is attached to the base plate 101 to form the external casing unit 107. Turning to FIG. 5(*d*)-(*e*), cover 106 is an elongated structure comprising a cover top wall 106*a* attached substantially orthogonally to two cover side walls 106*b* which extend outwardly from the cover top wall 106*a*, such that cover 106 has a substantially "u" shaped cross section. Each of the cover side walls 106*b* comprises an inward bend or longitudinal guide bracket 106*d* which are capable of mating with the base plate raised ridges 101*d* for attachment. As depicted, cover 106 is slid onto the base plate 101 towards base plate bottom 101*b* such that the inward bend or longitudinal guide brackets 106*d* of each cover side wall 106*b* sockets around the base plate raised ridges 101*d*, preventing the cover 106 from being pulled away from the base plate 101. The cover 106 is slid along the base plate raised ridges 101*d* until one end of the cover 106 comes into contact with the base plate bottom 101*b*. At that point, fasteners can be placed through cover apertures 106*c* and into the bottom brace 101*c* extending from the base plate bottom 101*b*, thereby securing the cover 106 in place and forming the external casing unit 107. Additional fasteners and clips (not depicted) can be used to further fasten the cover 106 to the base plate 101 if desired under the circumstances.

The side of the external casing unit 107 opposite the base bottom plate 101*b* is open, thereby allowing access to the internal compartment 0 defined by the external casing unit 107 wherein the internal gun holder unit 103 is housed. This forms an access tunnel 108 of the pre-determined length through which a user can access the internal gun holder unit 103. Thus, once the cover 106 is in place, firearm safety storage apparatus 100 can be used and the firearm fa can be loaded into or retrieved from the internal gun holder unit 103 as previously discussed herein. Moreover, in alternate embodiments, the side opposite the base bottom plate 101*b* may not be open, but may have an access door with a locking mechanism as would be known in the art. In such an embodiment, the use of the access tunnel 108 of a pre-determined length would act as an additional safety feature in the vent an unauthorized user was able to open the access door without authorization.

For the purpose of understanding the Firearm Safety Storage Apparatus, references are made in the text to exemplary embodiments of a firearm safety storage apparatus, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the Firearm Safety Storage Apparatus may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

I claim:

1. A gun storage apparatus comprising:

a. a back plate;

b. a gun holder unit;

c. a cover; and d. a mounting plate for positioning the holder unit wherein the mounting plate comprises a first plurality of holes through which the mounting plate can be mechanically attached to the back plate and a second plurality of holes through which the holder unit attached to the mounting plate;

wherein the cover is attached to the back plate such that the attached back plate and cover form an external casing that defines an interior chamber; wherein the external casing has an opening on one end; and wherein the external casing defines an access tunnel of a predetermined length to the gun holder unit such that an authorized user can reach the contents of the gun holder unit, but an unauthorized user could not reach the contents of the gun holder unit.

2. The gun storage apparatus as in claim 1 wherein the gun holder unit comprises a holder bracket and a gun securing means.

3. The gun storage apparatus as in claim 2 wherein the gun securing means comprises a securing foam system which defines an internal chamber capable of housing a firearm in a secure manner and wherein the securing foam system is attached to the back plate via the holder bracket.

4. The gun storage apparatus as in claim 3 wherein the securing foam system comprises at least one piece of foam wherein the at least one piece of foam comprises a top portion, a bottom portion, and a crevice in at least one side wall of the piece of foam; and wherein the holder bracket further comprises at least one catch such that when the at least one piece of foam is inserted into the holder bracket, the catch matches up and inserts into the crevice to secure the securing foam system to the holder bracket.

5. The gun storage apparatus as in claim 1 wherein the back plate comprises a vertical member and a bottom member attached substantially orthogonally to the vertical member at one end of the vertical member; wherein the bottom member comprises at least one bracket that is capable of being secured to the cover; and wherein the vertical member and bottom member form a portion of the external casing.

6. The gun storage apparatus as in claim 5 wherein the vertical member further comprises at least two base plate ridges on the vertical edges of the vertical members.; and wherein the cover has a cross section that is substantially U-shaped and comprises a pair of longitudinal guide brackets which are capable of sliding over and catching on the base plate ridges.

7. The gun storage apparatus as in claim 5 wherein an opening to the access tunnel defined by the external casing is opposite the bottom member of the back plate.

8. The gun storage apparatus as in claim 2 wherein the gun securing means is selected from a group comprising holsters, catches latches, foam, fasteners, ties, magnets, and straps.

9. The gun storage apparatus as in claim 1 further comprising a covering at the external end of the access tunnel that is capable of being manipulated to gain access to the access tunnel.

10. A gun storage apparatus comprising:

a. a back plate;

b. a securing foam system wherein the securing foam system is attached to the back plate via a holder bracket;

c. a cover attached to the back plate such that the back plate and cover form an external casing that defines an interior chamber, said interior chamber comprising a top that is open;

wherein the securing foam system is inside of the interior chamber at a predetermined distance from the top of the interior chamber;

wherein the securing foam system comprises at least one piece of foam wherein the at least one piece of foam comprises a top portion, a bottom portion, and a crevice in at least one side wall of the piece of foam; and wherein the holder bracket further comprises at least one catch such that when the at least one piece of foam is inserted into the holder bracket, the catch matches up and inserts into the crevice to secure the securing foam to the holder bracket.

11. The gun storage apparatus as in claim 10 wherein the predetermined distance is greater than the length of an average human child's arm.

12. The gun storage apparatus as in claim 10 wherein the external casing comprises a material from the group consisting of metal, plastic, pvc, fabric, Kevlar, wood, or combinations thereof.

13. The gun storage apparatus as in claim 10 wherein the back plate comprises a vertical member and mounting plate; wherein the mounting plate comprises a first plurality of holes through which the mounting plate can be mechanically attached to the vertical member and a second plurality of holes through which the holder bracket can be selectively attached to the mounting plate.

14. A gun storage apparatus comprising:

a. a back plate;

b. a gun securing unit;

c. a cover attached to the back plate such that the back plate and cover form an external casing that defines an interior chamber with an opening on one end;

wherein the gun securing unit is inside of the interior chamber;

wherein the back plate comprises a vertical member and a bottom member attached substantially orthogonally to the vertical member at one end of the vertical member and wherein the vertical member comprises vertical edges;

wherein the vertical member further comprises at least two base plate ridges on the vertical edges of the vertical member.

15. The gun storage apparatus of claim 14 wherein the gun securing unit is selected from the group consisting of holsters, catches, latches, foam, fasteners, ties, magnets, and straps.

* * * * *